United States Patent [19]

Cheetham

[11] 4,282,923

[45] Aug. 11, 1981

[54] REGENERATIVE HEAT EXCHANGE SYSTEMS

[75] Inventor: Stuart E. Cheetham, Sheffield, England

[73] Assignee: GR-Stein Refractories Limited, Sheffield, England

[21] Appl. No.: 961,045

[22] Filed: Nov. 15, 1978

[51] Int. Cl.[3] ..... F28D 17/00

[52] U.S. Cl. ..... 165/9.1; 165/9.4

[58] Field of Search ..... 165/9.1–9.4

[56] References Cited

U.S. PATENT DOCUMENTS

| | | | |
|---|---|---|---|
| 480,879 | 8/1892 | Stevenson | 165/9.1 |
| 490,726 | 1/1893 | Stevenson | 165/9.3 |
| 2,473,427 | 6/1949 | Hasche | 165/9.4 |
| 2,493,470 | 1/1950 | Tau | 165/9.4 |
| 3,030,093 | 4/1962 | Reintjes | 165/9.1 |

FOREIGN PATENT DOCUMENTS

| | | | |
|---|---|---|---|
| 85889 | 3/1936 | Sweden | 165/9.2 |

*Primary Examiner*—Albert W. Davis

*Attorney, Agent, or Firm*—Lowe, King, Price & Becker

[57] ABSTRACT

A regenerative heat exchange system comprises a multiplicity of refractory members laid in adjacent parallel rows to form one course in the system, each refractory member being so shaped such that the adjacent refractory members of one row co-operate to form a gas passageway or duct through that first course, the refractory members of an adjacent course being similarly arranged in parallel rows with the refractory members turned through 90° with respect to the refractory members of the first row and being offset therefrom, the adjacent members in each row in the second course again cooperating to form a gas passageway or duct through the adjacent course, each gas passageway or duct in the adjacent course constituting a continuation of a respective gas passageway or duct in the said one course.

5 Claims, 5 Drawing Figures

REGENERATIVE HEAT EXCHANGE SYSTEMS

This invention relates to regenerative heat exchange systems (for simplicity, hereinafter referred to as a chequer system) and to refractory members therefor.

Hitherto, conventional chequer systems have been produced from standard rectangular refractory bricks laid in a variety of patterns to form vertical or horizontal gas passageways or ducts to allow for the alternate passage of hot furnace exhaust gas in one direction and the subsequent opposite passage of air to be pre-heated for delivery to the furnace. When the chequer system displays vertical passageways or ducts, it is preferable to provide additional horizontal passageways across the chequer system to allow cleaning air to be blown through the chequer system. Thus, periodically during the passage of either hot gas and air alternatively through the chequer system a cleaning blast of air can be applied across the system.

The degree of accuracy to which standard bricks can be laid in producing such chequer systems is dependant upon the dimensional accuracy of the bricks themselves and the ability of bricklayers to lay such bricks. In addition, it is inevitable that by virtue of point loading of one brick course on the course below, movement of the bricks during service cannot be eliminated with the result that some of the gas passageways or ducts through the system can be restricted, and there is introduced an unacceptable degree of instability of the structure. It is also usually the case that standard rectangular bricks are placed on edge in each layer and which can also result in a degree of instability by virtue of the fact that the bricks can pivot about their vertical axes if, during operation, vibration due to noise occurs, or there is movement in the foundation, or when an explosion in the system occurs. Beyond that, the laying of standard bricks is time consuming even when utilising skilled bricklayers, and as the bricks are invariably laid dry, the construction is such that there is every likelihood of displacement of bricks during erection by virtue of the fact that bricklayers must walk across the structure.

According to the present invention, a regenerative heat exchange system comprises a multiplicity of refractory members laid in adjacent parallel rows to form one course in the system, each refractory member being so shaped such that the adjacent refractory members of one row cooperate to form a gas passageway or duct through that first course, the refractory members of an adjacent course being similarly arranged in parallel rows with the refractory members turned through 90° with respect to the refractory members of the first row and being offset therefrom, the adjacent members in each row in the second course again co-operating to form a gas passageway or duct through the adjacent course, each gas passageway or duct in the adjacent course constituting a continuation of a respective gas passageway or duct in the said one course.

Preferably all the refractory members are of the same shape, and it is further preferred that they are generally I-shaped. Thus the members may be laid such that adjacent flanges of adjacent I-shaped refractories abut to form a generally rectangular passageway or duct, and the member can be so laid such that their edge faces are lowermost and uppermost when the passageways or ducts are generally vertically disposed, or with their flanges lowermost and uppermost when the passageways or ducts are horizontally disposed.

With the gas passageway or duct either horizontally or vertically disposed, standard rectangular bricks may be laid between adjacent refractory members in adjacent courses to produce further passageways extending across the chequer system at 90° to the gas passageway or ducts. This is of particular advantage when the gas passageways or ducts are vertically disposed and when a side blast of cleaning air can be introduced through the system.

To complete the system, the endmost refractory member in each row can be abutted by a refractory member to cooperate with the endmost refractory member to produce the end passageway or duct. Thus, when I-shaped members are utilised, the C-shaped member abuts the flanges of the I-shaped member.

Thus, irrespective of the disposition of the gas passageway or ducts, the nature of the configuration of each refractory member is such that with refractory members laid to produce parallel adjacent rows in each course, a high degree of stability is provided even when unskilled labour is utilised. Because of the shape, particularly when I-shaped refractories are utilised, each member rests on the course below (or on the foundation) by its side or by its flange, when a far greater surface area of contact is provided than with standard bricks eliminating point loading, hence substantially reducing the risk of member movement during service, and substantially eliminating the possibility of any pivotal movement of the member caused by vibration, foundation movement or explosion in the system. It is equally the case that once the first course is accurately laid even unskilled labour can ensure that the succeeding courses are equally accurately laid despite the fact that the members of adjacent courses need to be turned through 90° and offset. The continuance of the passageway or duct establishes the exact position required to be taken by each shape in the courses as they are being laid. This results in far faster installation as well as producing a rigid structure even though members are laid dry such as to allow an operative to walk across the structure with far less risk of disturbing the members as is the case with conventional brick constructions. A further advantage is that the accuracy of laying afforded by the construction of the invention can reduce overall height tolerance required for a given height of chequer packing than is necessary when utilising standard rectangular bricks.

One embodiment of the invention will now be described with reference to the accompanying drawings in which.

Figure 1:
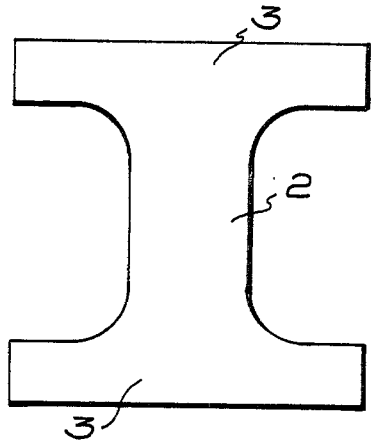
FIG. 1 is a plan view of a refractory member for use in a chequer system according to the invention.
Figure 2:
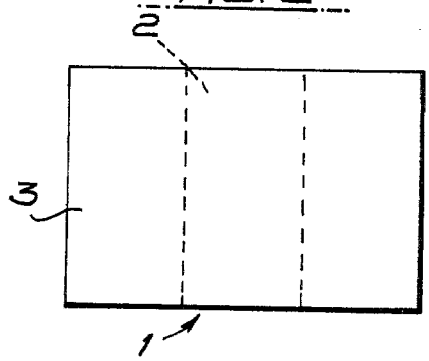
FIG. 2 is a side elevation of the refractory member of FIG. 1.
Figure 3:
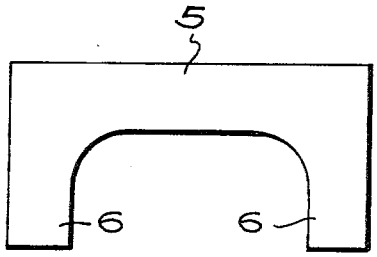
FIG. 3 is a plan view of an endmost refractory member for use in a regenerative heat exchange system according to the invention.
Figure 4:
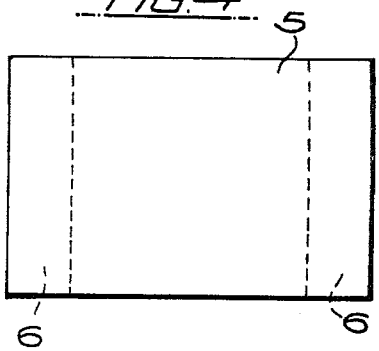
FIG. 4 is a side elevation of the member of FIG. 3.

In FIGS. 1 and 2, a refractory member 1 for a regenerative heat exchange system (chequer system) is generally I-shaped with a web 2 and flanges 3. As is shown in FIGS. 3 and 4, a second refractory member 4 is generally C-shaped having a flat end wall 5 and flanges 6 extending from the wall 5 in the same direction.

Figure 5:
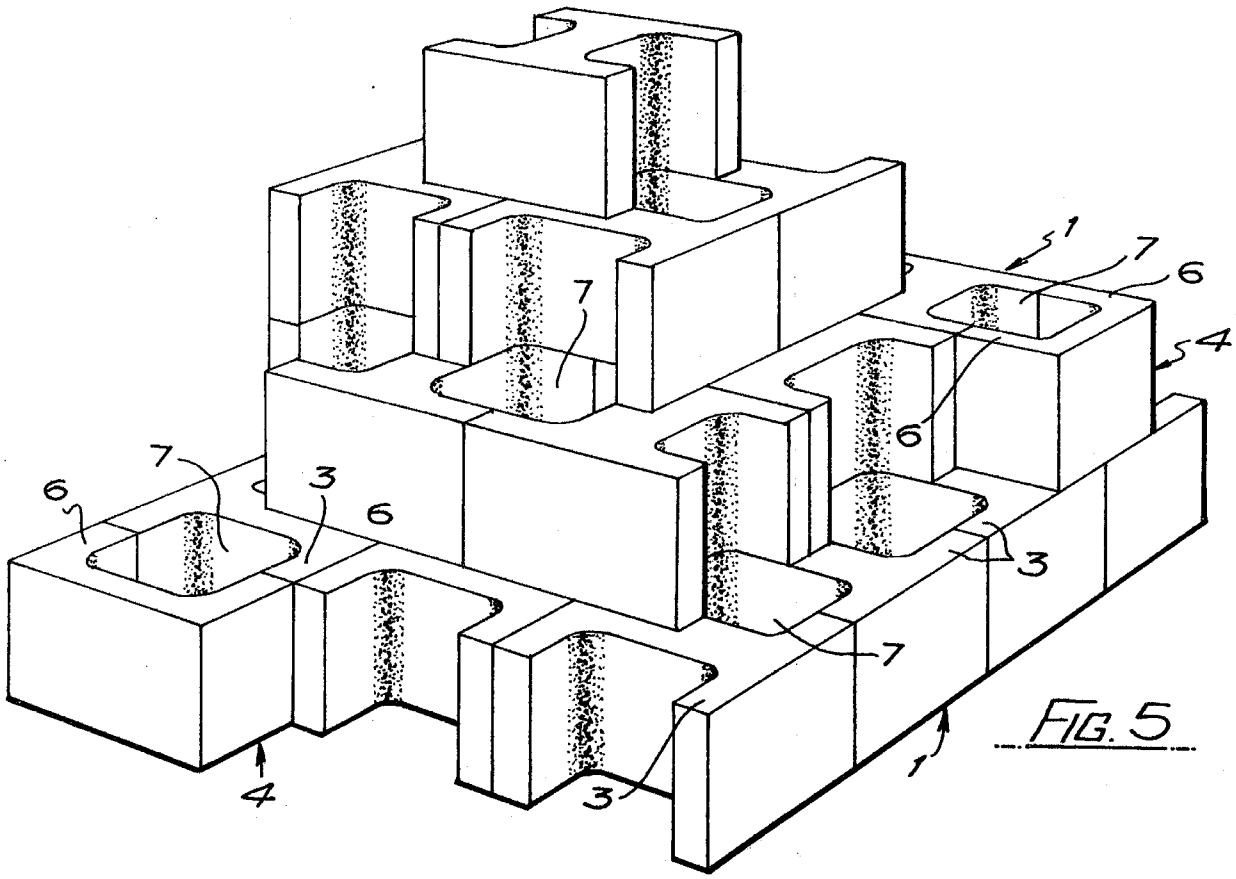
FIG. 5 is a perspective view of part of a regenerative heat exchange system utilising the members of FIGS. 1 to 4.
Figure 6:
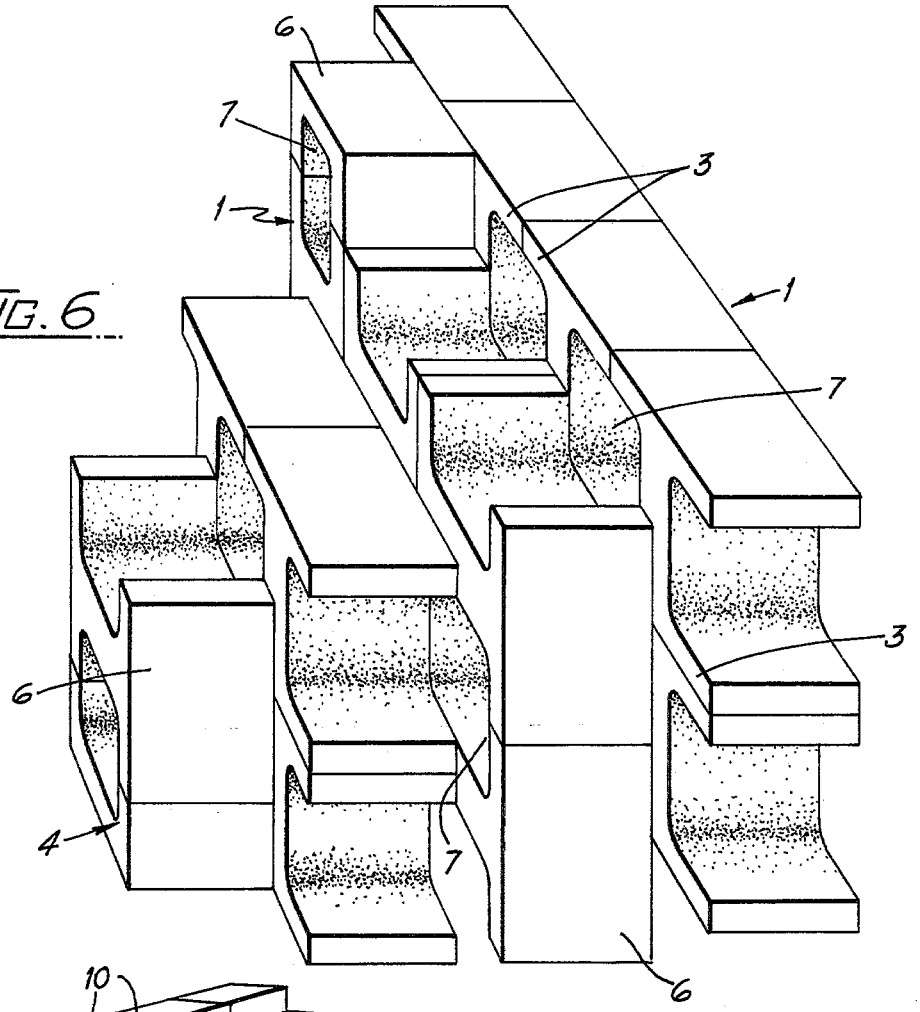
Figure 7:
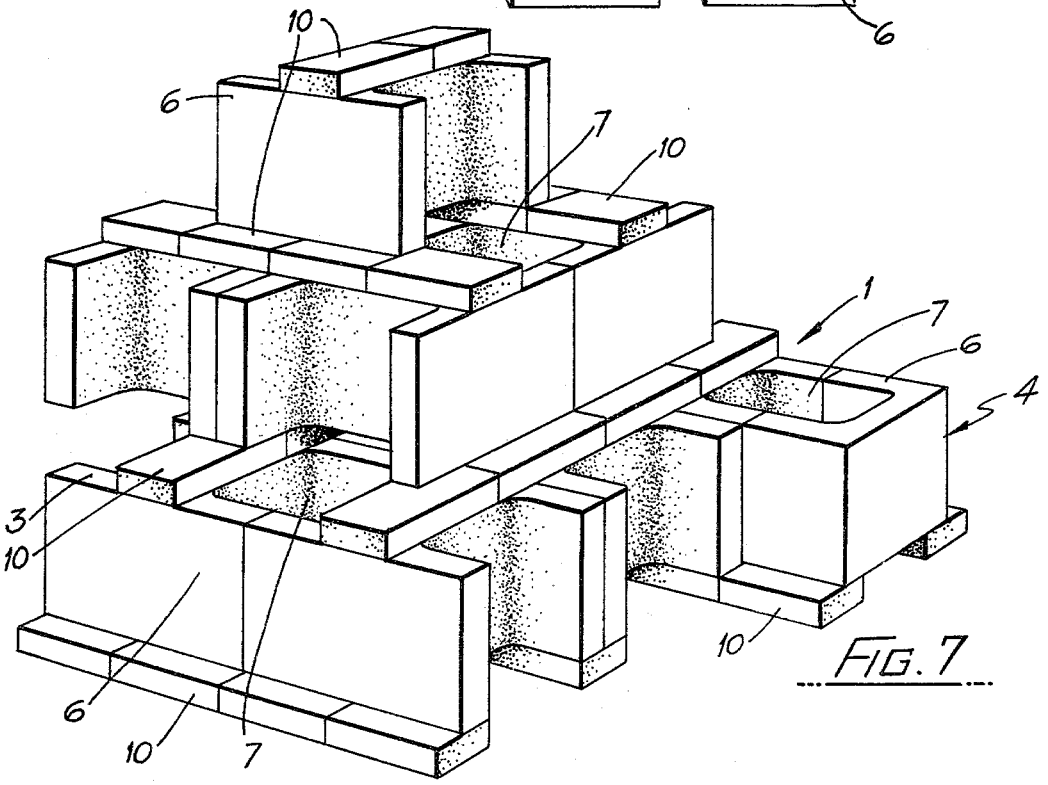

Thus, as is shown by FIG. 5, a number of refractory members 1 are laid in side-by-side relationship in a first (lowermost) course with the flanges 3 of adjacent members 1 abutting each other to define between adjacent flanges, a first part of a vertical gas passageway or duct 7. An endmost duct 7 is formed by positioning a C-shaped member 4 such that its flanges 6 abut the flanges 3 of the endmost I-shaped member.

In the second course of members, the I-shaped member 1 are turned through 90° with respect to the members 1 of the first course and are offset from the members of the first course such that the part of the gas duct 7 formed by the members of the second row are in exact alignment with the part of the ducts 7 formed by the members of the first row. Again a C-shaped member 4 is placed in the second course such that its flanges 6 abut the flanges 3 of the endmost I-shaped member 1 of the second course to complete the uppermost duct 7. The members of the third row are turned through 90° with respect to the members of the second row and therefore back to the position of the members in the first row.

Therefore so long as the members of a first course in a chequer system are accurately set in position the subsequent laying on of successive courses of refractory members can be effected with great simplicity, accuracy and reliability. The surface area of contact between the members of one course and the course below (or the foundation) is such that a high degree of stability is provided with the eliminating of point loading and the substantial eliminating of any possibility of any pivotal movement of a member caused by vibration, foundation movement or explosion in the system. The stability is also such that the chequer system can be walked across during installation without there being the damger of any displacement of any of the refractory members.

FIG. 5 shows the refractory members 1 and 4 disposed to produce vertical passageways. It will be readily understood that by turning the members through 90° such that the lower course rests on the foundation by the flanges 3 and successive courses rest on the course below by the flanges 3, but by maintaining the same relative positioning of the members of adjacent courses a chequer system would be produced having horizontal passageways as frequently required.

With the passageways or ducts 7 either vertically or horizontally disposed, although not shown, standard refractory members may be laid between adjacent refractory members 1 and adjacent refractory members 4 to produce further passageways extending across the chequer system at 90° to the gas passageway or ducts 7. This is of particular advantage when the ducts 7 are vertically disposed as shown and when a side blast of cleaning air can be introduced through the system.

The invention therefore provides a simple, robust and efficient chequer system which does not of necessity require the use of skilled labour in its production.

What we claim is:

1. A regenerative heat exchange system comprising a multiplicity of refractory members laid in adjacent parallel rows to form one course in the system, each refractory member being so shaped as to provide a central generally web-like portion with flanges towards each end of the generally web-like portion extending to both sides, such that when the refractory members are laid, the flanges on adjacent refractory members abut to form a gas passageway or duct through that first course, the refractory members of an adjacent course being similarly shaped and arranged in parallel rows with the refractory members turned through 90° with respect to the refractory members of the first row and being off-set therefrom, the flanges of adjacent members in each row in the said second course again abutting to form a gas passageway or duct through the adjacent course, each gas passageway or duct in the adjacent course constituting a continuation of a respective gas passageway or duct in the said one course.

2. A regenerative heat exchange system as in claim 1, wherein the refractory members are so laid such that their edge faces are lowermost and uppermost when the passageways or ducts are generally vertically disposed.

3. A regenerative heat exchange system as in claim 1, wherein the refractory members are so laid such that their flanges are lowermost and uppermost when the passageways or ducts are horizontally disposed.

4. A regenerative heat exchange system as in claim 1, wherein standard rectangular bricks are laid between adjacent refractory members in adjacent courses to produce further passageways extending across the chequer system at 90° to the gas passageway or ducts.

5. A regenerative heat exchange system as in claim 1, wherein a further refractory member is provided formed by a generally web-like portion with flanges to one side only of the generally web-like portion, the flanges on said further member abutting the flanges of an endmost refractory member in each row, to produce an end passageway or duct to each row.

* * * * *